United States Patent [19]

Burgess

[11] 4,376,380

[45] Mar. 15, 1983

[54] COMBINATION LOCK

[75] Inventor: George M. Burgess, Webster, N.Y.

[73] Assignee: John D. Brush & Co., Inc., Rochester, N.Y.

[21] Appl. No.: 226,717

[22] Filed: Jan. 21, 1981

Related U.S. Application Data

[63] Continuation-in-part of Ser. No. 118,735, Feb. 5, 1980, abandoned.

[51] Int. Cl.[3] ..... E05B 37/08

[52] U.S. Cl. ..... 70/303 A; 70/329

[58] Field of Search ..... 70/303 R, 303 A, 315, 70/318, 323, 325, 329, 333, 442

[56] References Cited

U.S. PATENT DOCUMENTS

| | | | |
|---|---|---|---|
| 1,000,889 | 8/1911 | Bennett | 70/325 |
| 1,847,392 | 3/1932 | Full | 70/303 R |
| 2,322,724 | 6/1943 | Archer | 70/325 |
| 2,779,185 | 1/1957 | Papini | 70/303 A |
| 2,807,954 | 10/1957 | Miller | 70/303 A |
| 2,836,049 | 5/1958 | Papini | 70/303 R |
| 2,991,644 | 7/1961 | Edwards | 70/303 R |
| 3,106,083 | 10/1963 | Maynard | 70/333 |
| 3,472,049 | 10/1969 | Sewell | 70/303 R |

FOREIGN PATENT DOCUMENTS

| | | | |
|---|---|---|---|
| 929982 | 7/1973 | Canada | 292/DIG. 38 |

*Primary Examiner*—Robert L. Wolfe

*Attorney, Agent, or Firm*—Stonebraker, Shepard & Stephens

[57] ABSTRACT

A combination lock to be installed on a panel such as a safe door, with a manually operable knob and dial at the front of the panel and the main part of the combination mechanism at the rear of the panel. A rotary operating spindle attached to the dial and a stationary bushing surrounding the spindle extend through the thickness of the panel and are made of non-metallic material having low heat conductivity, such as nylon. An operating or driving wheel or disk fixed to the rear end of the spindle has a projection for engaging and rotating a locking wheel or disk rotatable on the bushing in front of the operating disk, and this locking wheel engages and rotates another locking wheel in front of it. When radial slots in the locking wheel and the operating wheel are all in a predetermined alignment, a spring moves a finger on a slide member into the aligned slots, and this moves the latch bolt to an unlocked position. A cam portion on the operating disk moves the slide member back to normal locking position when the dial is turned. A spring connection between the latch bolt and the slide member allows the latch bolt to retract even though the locking disk slots are not aligned for unlocking, so the safe door may be closed even when the lock is in locked position.

18 Claims, 10 Drawing Figures

COMBINATION LOCK

CROSS REFERENCE TO RELATED APPLICATION

This application is a continuation-in-part of application Ser. No. 118,735, filed Feb. 5, 1980 and now abandoned.

BACKGROUND OF THE INVENTION

This invention relates to combination locks such as used on safes, doors of vaults, and the like. Many styles and forms of such locks are known in the art.

The present invention aims to provide a combination lock which is comparatively easy and inexpensive to manufacture, which is therefore suitable for use on comparatively inexpensive safes and strong boxes, and which is highly resistant to attempts to burglarize or break open the lock from the outside.

Other aims and objects of the invention are to provide such a lock so constructed as to minimize transfer of heat through the lock structure in case of a fire, and so constructed as to enable a large number of changes of the numerical combination needed to open the lock, without however going to the expense of providing movable and resetable parts on each lock wheel.

Another object of the invention is the provision of a combination lock having some or all of the above mentioned advantages, which is so constructed that the door to which the lock is applied may be closed and latched when the lock is in the locked position, without damaging or unduly straining any parts of the lock.

A further object is the provision of a lock design which can be adapted to any desired thickness of door or wall to which it is to be applied, and which can be mounted directly on the inner side of the door or wall itself, without having to be mounted in a separate box or compartment secured to the inner face of the door, as is necessary with many of the combination locks of the prior art.

SUMMARY OF THE INVENTION

The combination lock of the present invention includes a spindle rotatably mounted in a spindle bushing which goes through the thickness of the door or wall, with the operating knob at the outer end of the spindle and with the rest of the lock mechanism operatively connected to the inner end of the spindle. Both the spindle bushing and the spindle itself are made of nylon rather than of metal, to minimize transmission of heat through the thickness of the door or wall on which the lock is mounted, in the case of a fire on the outside of the structure. A plastic drive disk fixed to the inner end of the spindle drives a steel lock wheel, which in turn drives another steel lock wheel in a construction having two lock wheels, and the second wheel may drive a third one if three lock wheels are desired.

When the proper combination is set by turning the external operating knob first in one direction and then in the other direction as commonly done with combination locks, slots on the lock wheels and on the drive wheel all line up with each other and with an abutment finger on a latch slide, so that a spring can move this latch slide to retract the finger into the slot in the wheels, and this movement of the slide carrys with it the latch itself, which has limited sliding movement on the slide. Even when the lock mechanism is in locked position so that the slide finger can not move into the slots in the wheels, the latch itself can nevertheless move relative to the slide, against the action of springs, to an unlatching position, so that the door can be closed without damage to the parts.

DESCRIPTION OF THE PREFERRED EMBODIMENT

Figure 1:
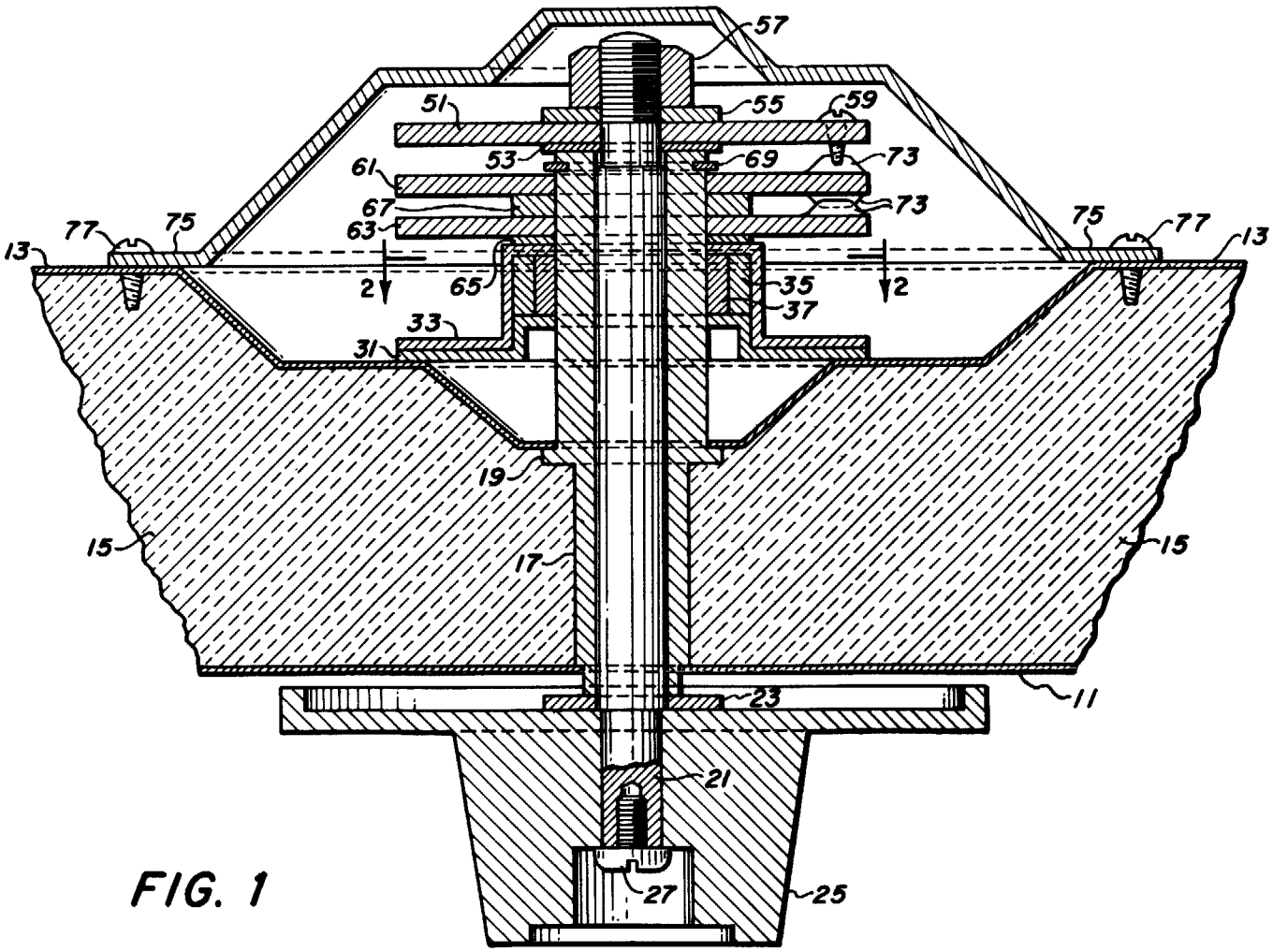
FIG. 1 is a cross section taken centrally and axially through a lock according to one embodiment of the invention.

Referring now to the drawings, and especially to FIG. 1, the lock of the present invention is illustrated as applied to a door of a safe or storage box, the door panel having an outer cover sheet 11, an inner sheet or liner 13, and a filling 15 of insulation material. The inner sheet 13 may be dished in the vicinity of the lock, as illustrated, to provide a space for receiving part of the thickness of the lock.

A bushing 17 extends through the thickness of the door or panel and has an outwardly projecting radial flange 19 located just in front of the member 13, preventing the bushing from moving inwardly toward the interior of the safe or box. A spindle 21 is rotatable within this bushing 17. One of the features of the present invention is that both the bushing and the spindle are not made of metal, which would be the customary construction in conventional combination locks, but on the contrary they are both made of nylon, which has a low coefficient of heat transmission. In the conventional construction, when there is a hot fire outside, much heat can be transmitted to the interior of the safe through the metal bushing and spindle of the lock, with consequent damage to paper or other heat-sensitive items within the safe. With the present construction, transmission of heat through the lock structure occurs only to a very slight extent, because of the use of plastic material of low heat transmissibility for the bushing and the spindle.

Near its outer end the bushing has a shoulder which bears against the inner face of the door plate 11 as illustrated, so that the bushing is held against any axial movement by this shoulder plus the flange 19. At the outer end of the bushing is a nylon washer 23 surrounding the spindle 21, and in front of this washer the spindle carries a dial member 25 which has a central hole of square cross section fitting snugly on a square forward end portion of the spindle 21 and held thereon by the screw 27. This dial member constitutes the manual operating knob, as conventional in combination locks, and its front face is circumferentially graduated with 100 subdivisions suitably numbered, so that each graduation in angularly spaced 3.6 degrees from the next one. This is the conventional form of graduation of combination lock dials, and need not be illustrated. When the dial is turned to set up the proper combination of numbers to open the lock, the graduations are read in connection with the usual conventional index mark or reference point on the front surface of the door or other panel on which the lock is mounted.

Figure 2:
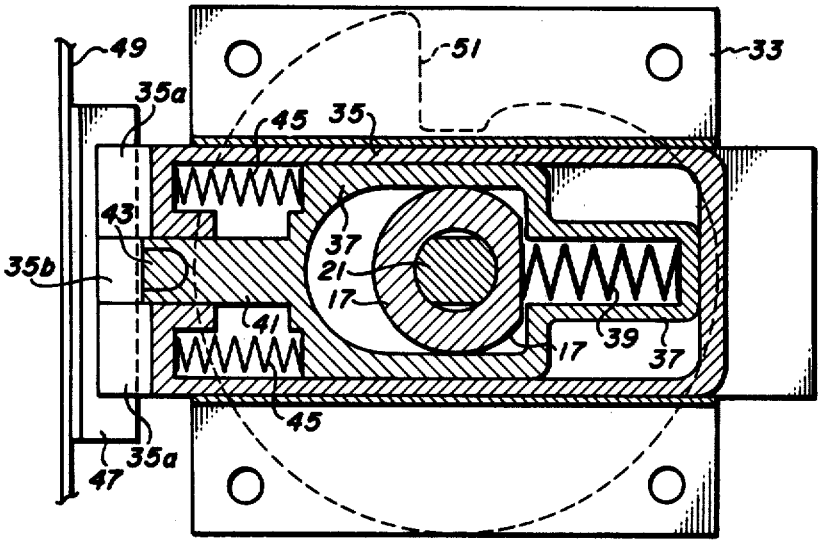
FIG. 2 is a transverse section approximately on the line 2—2 of FIG. 1.

A base plate 31, having the cross sectional shape shown in FIG. 1 and the outline shown in FIG. 2, is firmly attached to the inside face of the door panel as by screws or bolts. A latch housing 33, having the cross sectional shape shown in FIG. 1, fits over the base plate 31 and is firmly attached to it and to the inner face of the door panel. These parts are made preferably of metal stampings. Both the base plate and the latch housing are centrally apertured with enough space so that the spindle 21 and bushing 17 may extend through them. Although the lateral marginal flanges of these members 31 and 33 are in contact with each other, the intermediate parts between these lateral flanges are separated from each other in a direction axially of the spindle and bushing, to provide space for slidably receiving the latch member 35 and the latch slide 37.

Figure 7:
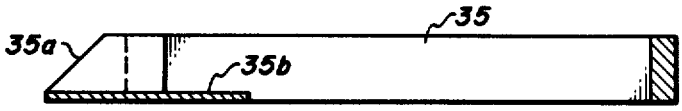
FIG. 7 is a vertical longitudinal section through the latch member.

The latch member or latch bolt 35 is preferably a metal die casting, of approximately rectangular outline (FIG. 2) with side walls which fit slidably between the side walls of the latch housing 33 as seen in FIGS. 1 and 2. The side walls of this latch member are connected at the rear end by a rear wall as seen in FIG. 2. At the front or locking end of the latch member, there is a front wall, the front face of which is bevelled or sloped at an angle of about 45 degrees as seen at **35*a* in the side view of this member, FIG. 7. Also, the front wall has a central slot to receive part of the latch slide 37 as further described below, and the latch member has a partial bottom wall 35*b* extending across from one side to the other at its front end (FIG. 7**) to give the front end the necessary strength and rigidity.

Figure 6:
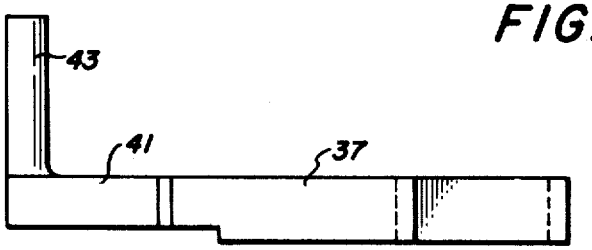
FIG. 6 is a side elevation of the latch slide member.

The latch slide 37 (FIGS. 1, 2, and 6) fits within and has a limited degree of sliding movement in the space inside the latch member 35. The central part of the latch slide is open, and the spindle 21 and its bushing 17 extend through this open central part, as indicated in FIGS. 1 and 2. The side walls of the slide 37 straddle the bushing 17 and slide along the inner faces of the side walls of the latch member 35. The rear part of the slide is somewhat narrower and serves as a chamber for receiving the coiled compression spring 39 which presses forwardly on a flattened part of the stationary bushing 17 and rearwardly on the latch slide 37, tending to move this slide rearwardly.

A narrow forwardly extending part 41 on the slide 37 extends through the previously mentioned slot in the front end of the latch member 35, and has a rigid upstanding finger 43 (FIG. 6) which engages the peripheries of the drive wheel and/or lock wheels of the combination lock, as further described below, to prevent the slide 37 from moving rearwardly under the influence of the spring 39 except when the notches in the drive wheel and lock wheels are properly lined up in the unlocking position.

Two coiled compression springs 45, positioned as illustrated in FIG. 2, press rearwardly on the latch slide 37 and forwardly on the latch 35, constantly tending to keep the latch 35 at its forward or outermost limit of movement relative to the slide 37, which limit is determined by contact of the inner face of the rear wall of the latch member 35 with the rear end of the latch slide 37. However, while the latch slide remains in the same position, the latch itself can move rearwardly relative to the slide, simply compressing the springs 45. This enables the structure with which the lock is used to be closed even when the lock is in the locked position, without damage to any parts. If the lock is mounted on a door panel which is open and the lock wheels are turned so that they prevent the finger 43 from moving inwardly toward the spindle, a closing movement of the door panel will engage the sloping end **35*a* of the latch member with the keeper plate or strike plate 47 (FIG. 2) mounted on some stationary part 49 of the structure, and the sloping surface of the latch member will be cammed inwardly against the force of the springs 45**, until the latch passes beyond the strike plate and snaps behind it, completing the locking of the door or other panel on which the combination lock is mounted.

Firmly fixed to the spindle 21 near its rear end is a drive wheel 51 (FIGS. 1 and 3) made of any suitable rigid material but preferably of the plastic material known as "Delrin 500." Conveniently the rear end of the spindle is flattened on two opposite sides, and the central opening in the drive wheel 51 is of similar shape (see FIG. 3) and the drive wheel is retained on the spindle between a nylon washer 53 and a steel washer 55 by a locking nut 57.

Figure 3:
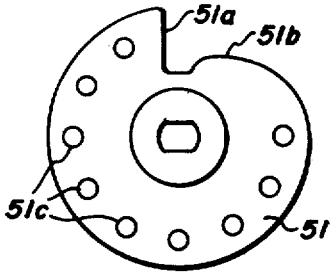
FIG. 3 is a plan of the drive wheel of this embodiment.

The shape of the drive wheel 51 is seen in FIG. 3. Most of the periphery is circular, concentric with the spindle on which it is mounted. At one point, there is an approximately radial shoulder **51*a* forming one side of a deep radial notch, and the other side of this notch is formed as a smooth spiral cam 51*b* which rises to the main circular periphery of the wheel in about a quarter or slightly less than a quarter of the circumference. Slightly in from the edge of the drive wheel there is a series of circumferentially spaced holes 51*c*, in any selected one of which a drive screw 59 may be tightly screwed. A metal screw will easily form threads in the softer plastic material, as it is being screwed in, so it is not necessary to tap the holes 51*c* in advance, thus saving manufacturing cost. These holes 51*c* may be of any desired number and any desired angular spacing from each other. As shown, there are preferably nine holes spaced 30 degrees angularly from each other, adjacent that part of the periphery which is circular, there being no holes in that part where the cam 51*b*** is located.

Beneath the drive wheel 51, but mounted rotatably on the bushing 17 rather than being mounted on the spindle, there are lock wheels of any desired number, two being shown at 61 and 63. They rotate on the stationary bushing 17, between a spring washer 65 below the lowest lock wheel, a nylon spacer washer 67 between the lock wheels, and a retaining ring 69 set into a circumferential retaining groove near the inner end of the bushing 17. The spring washer 65 produces a slight amount of frictional drag on the lock wheel assembly, allowing the wheels to be turned easily but keeping them in the respective positions to which they are set during the manipulation of the combination of the lock. Also this spring washer 65 serves to take up or compensate for accumulated manufacturing tolerances even if fairly liberal tolerances are permitted, thereby saving manufacturing expense since high precision is not required.

Figure 4:
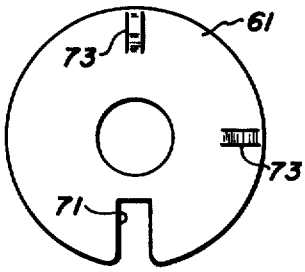
FIG. 4 is a plan of one of the lock wheels.
Figure 5:
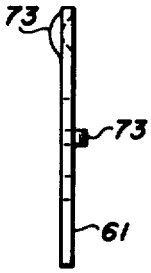
FIG. 5 is an edge view of the lock wheel shown in FIG. 4.

Each of these lock wheels 61 and 63 is of the shape shown in FIGS. 4 and 5. Each wheel has a circular periphery concentric with the bushing on which it is mounted, except for one radial notch 71. Each wheel also has two drive tabs or lugs 73, one projecting from one face and the other projecting from the opposite face of the lock wheel. In the preferred construction, the two drive tabs on each wheel are spaced angularly 90 degrees from each other, but their angular orientation relative to the notch 71 may be varied as desired (during the manufacturing operation) by increments of 3.6 degrees. The tabs are preferably formed by a stamping process, the lock wheels being made of sheet steel and the tabs being stamped out by pressure exerted against one side in a limited area to force a tab to protrude from the other side in the area where the force is exerted in the stamping operation.

The length of the drive screw 59 on the drive wheel 51 is such that as the drive wheel is turned (by turning the dial 25 and spindle 21) the end of the drive screw 59 projecting beyond the forward face of the wheel 51 will engage the tab 73 on the rear face of the first lock wheel 61 and turn this wheel. The tab on the front face of this wheel 61 will engage the drive tab on the rear face of the next lock wheel 63 and turn this wheel. If a third lock wheel is used, the drive tab on the front face of the second lock wheel will engage the drive tab on the rear face of the third lock wheel and turn it. Merely for the sake of more convenient illustration and understanding, the drive tabs on the front and rear faces of the first lock wheel 61 are illustrated in FIG. 1 as being on the same radial line so that both are shown. But they are actually on different radial lines preferably 90 degrees from each other, as shown in FIG. 4.

The nylon spacer washer 67 is held against rotation by any suitable means. For example, the bushing 17 may have a longitudinal groove extending from the vicinity of the washer 67 to the rear end of the bushing, and the washer may have a tab projecting radially into the groove. The holding of this washer against rotation prevents any tendency of rotation of the first lock wheel 61 to cause rotation of the second lock wheel 63 by turning the washer. The second lock wheel should be driven only by contact of the respective drive tabs of the wheels.

The diameter of the plastic drive wheel 51 is very slightly larger, by a few thousandths of an inch, than the diameter of the lock wheels 61 and 63. Therefore, the drive wheel 51 normally holds the finger 43 of the latch slide 37 out of contact with the periphery of the lock wheels, so it is impossible to learn the proper combination numbers of these lock wheels by either hearing or feeling the finger make contact with the corners at the outer ends of the radial notches in the lock wheels when the dial is rotated by one not having the combination of the lock.

The construction is completed by a suitable cover or housing 75 of somewhat dome shape as illustrated in FIG. 1, held on the inner face of the door or other panel on which the lock is mounted by suitable screws 77. This cover member 75 may conveniently be made of molded plastic material such as polystyrene.

The operation of the lock is much like that of a conventional combination lock. When the dial is turned, the drive screw 59 on the drive wheel 51 makes contact with the drive tab on the rear face of the first lock wheel 61 and turns it. The drive tab on the front face of this wheel makes contact with the drive tab on the rear face of the second lock wheel 63 and turns it. If the person knows the proper combination, he stops turning when the proper number for the lock wheel 63 is reached, and begins turning in the opposite direction. This will leave the wheel 63 in position with its radial slot or notch opposite the finger 43. Turning the dial in the opposite direction through something more than one complete revolution to the proper number will finally bring the first lock wheel 61 around so its radial slot will be opposite the finger 43. At this time the finger will still be riding on the periphery of the drive wheel 51, so can not drop into the slots in the lock wheels. The dial is now turned back in the first direction to the proper number, leaving the lock wheel 61 where it was and bringing the slot of the drive wheel 51 around to the finger 43. The spring 39 can now retract the latch slide 37, moving the finger 43 into the aligned slots of the wheels 51, 61, and 63, and this movement of the slide 37 carries the latch member or latch bolt 35 with it, unlocking the safe door or file cabinet or whatever structure is protected by this combination lock.

Figure 9:
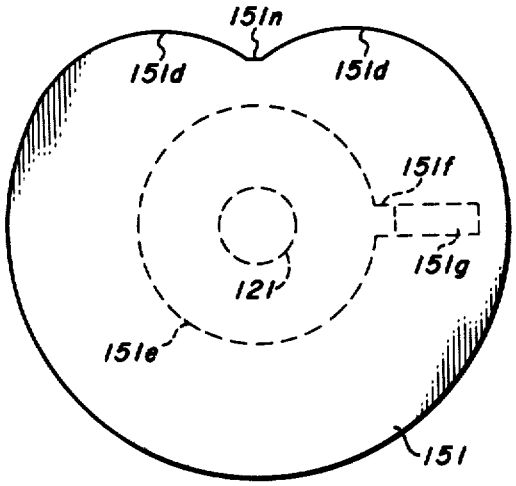
FIG. 9 is a plan of the drive wheel of the second embodiment.
Figure 10:
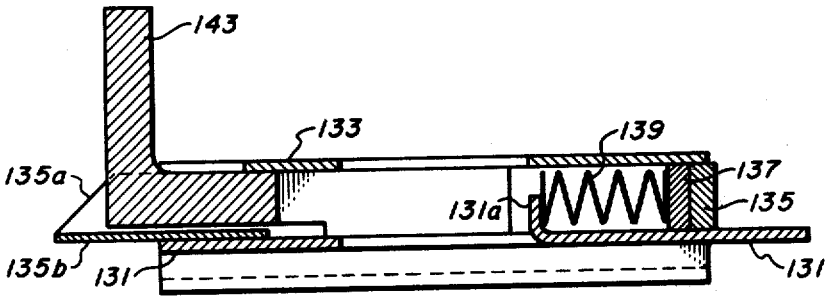
FIG. 10 is a central vertical section through a latch sub-assembly according to the second embodiment.

A secnd embodiment of the invention, improved in some respects as compared with the first embodiment described above, will now be described with reference especially to FIGS. 8, 9, and 10. In this second embodiment, the various parts are designated by the same reference numerals used for the corresponding parts in the first embodiment, increased by 100, so that, for example, the bushing 17 and spindle 21 of the first embodiment are designated respectively as the bushing 117 and spindle 121 in the second embodiment. Where the constructions are significantly different, the differences will be explained below. Where differences between corresponding parts of the two embodiments are not mentioned, it is to be understood either that the corresponding parts are substantially identical or that the differences are not significant.

Figure 8:
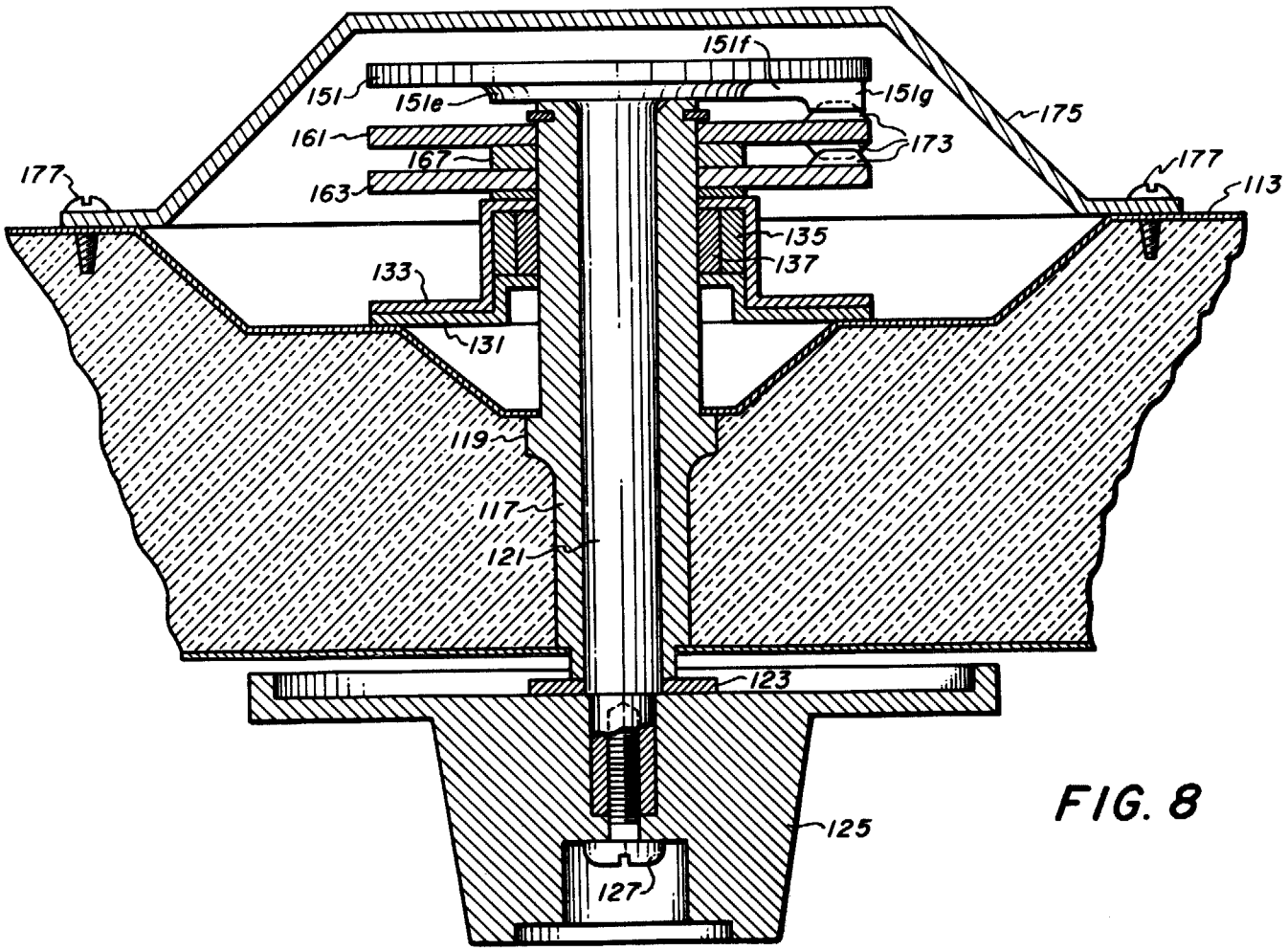
FIG. 8 is a view similar to FIG. 1, showing a second embodiment of the invention.

Referring now to FIG. 8, the bushing 117 in this second embodiment is approximately the same as the bushing 17 in the previous embodiment, but is of somewhat different shape, as illustrated. It performs the same function as the bushing in the first embodiment, and contains the spindle 121 which, like the bushing, is made of nylon for the reasons mentioned above.

In the present improved construction, the spindle 121 is molded integrally with the drive wheel 151, thus eliminating the need for the washer 55 and retaining nut 57 used in the first embodiment. This enables the cover 175 to have a flat shape in its central portion, eliminating the need for the small projecting dome at the center of the cover as required in the first embodiment (FIG. 1) in order to give clearance for the nut 57. The elimination of this projection increases the usable space within the safe or container with which the combination lock is used.

The drive wheel 151, now formed integrally with the spindle 121 as above mentioned, is shaped somewhat differently from the previous drive wheel 51. The new shape is illustrated in FIG. 9. The periphery of the wheel is circular and concentric with the spindle 121 through most of its circumference, but at one point there is the notch **151*n*, and the periphery flares on a cam curve 151*d* in both directions from the bottom of the notch 151*n*. With this shape, the dial and spindle can be turned in either direction from the unlocked or correct combination position, and the finger 143 will ride up the incline 151*d* no matter which way the drive wheel is turned. Thus there is no danger of damaging the finger 143 by applying excessive pressure in trying to turn the external dial in a wrong direction. This contrasts with the shape shown in FIG. 3 in the first embodiment, where only one side of the notch had a cam 51b and the other side of the notch had a straight radial side 51a**, so the dial could be turned in only one direction from the unlocked position.

The under surface of this drive wheel 151 is formed with a thickened central hub portion 151e of approximately circular shape (FIG. 9) with a radial extension 151f at a point spaced 90 degrees angularly from the notch 151n. The outer end of this radial extension is thickened as shown at 151g, to a sufficient extent to make contact, during rotation, with the projection or tab 173 on the adjacent face of the adjacent lock wheel 161. The lock wheels 161 and 163 may be the same as the lock wheels 61 and 63 in the first embodiment, and operate in the same way. The thickened portion or lug 151g on the drive wheel 151 thus serves the same purpose or function as the screw 59 in the first embodiment, in that it serves to drive the wheel 161 and causes this wheel to drive the next wheel 163, just as in the first embodiment. The difference is that this driving lug 151g in the second embodiment is in fixed position and cannot be moved to various positions to alter the combination, the way the screw 59 can be shifted to different holes 51c in the first embodiment.

Another difference between the two embodiments is in the latch mechanism. In the first embodiment, the latch base plate 31, housing 33, latch bolt 35, slide 37, and the springs 39 and 45, were all separate parts which had to be assembled around the bushing 17 because one end of the spring 39 was held in place by contact with the flat side of the bushing, as seen in FIG. 2. In case of any breakage in service, it was time consuming for service personnel to disassemble these parts and assemble them again upon making any necessary replacement of a broken part. In the second embodiment of the invention, this is overcome by making the above mentioned latch parts a permanently assembled sub-assembly, assembled initially at the factory under the most favorable conditions of minimum labor expense, and not disassembled thereafter. If anything breaks in the latch mechanism, the entire sub-assembly is quickly removed and discarded, and is replaced by a new sub-assembly from the factory, so that the entire repair may be accomplished by service personnel in the field, at a fraction of the time required for servicing the previous design.

To this end, the base plate 131 is formed with an upstanding lug or tab 131a (FIG. 10) which forms an abutment to hold the front end of the spring 139, the rear end of which pushes against the rear wall of the latch slide 137, just as in the first embodiment. The latch slide 137 and its upstanding finger 143 may be the same as the corresponding members 37 and 43 in the first embodiment; likewise the latch 135 may be the same as in the first embodiment, and also the latch cover 133. As before, the spindle 121 and its sleeve or bushing 117 extend through appropriate openings in the members 131, 133, 135, and 137, and the various springs operate just as before, with the exception that the spring 139 presses forwardly against the tab 131a instead of pressing against the bushing.

Because of this tab, it does not matter whether the bushing is in place or not, when the latch parts are assembled. Therefore, when the latch parts have been assembled at the factory, the flat lateral flanges of the housing 133 are spot welded to the flat lateral flanges of the base plate 131, making a permanent sub-assembly of these latch parts.

This sub-assembly is secured to the inner liner 113 of the safe or other container, in any suitable way. Screws may go through appropriate holes in the lateral flanges of the members 131 and 133 (see the holes, not numbered, near the corners of the member 33 in FIG. 2) and be screwed right into the thin metal of the liner 113. But a more secure fastening is achieved by providing small square holes (not shown) in the sheet metal liner 113, for receiving Tinnerman nuts, and then the screws which go through the holes in the flanges of the members 31 and 133 are screwed into the Tinnerman nuts instead of merely into the sheet metal plate 113.

The new shape of the bushing 117, as compared with the original shape 17, gives added strength to this bushing, and substitutes a curved fillet in place of a sharp angular corner.

The dial 125 is essentially the same as the dial 25 in the previous embodiment, but has been slightly changed to overlie part of the front end of the spindle 121, as seen in FIG. 8. The screw 127 holds the dial securely in place, on the squared front end of the spindle.

Except for these changes above described, the second embodiment of the invention may otherwise be the same as the first embodiment, and operates in the same way.

Both embodiments of the invention provide a very effective lock, without the expense of using high precision parts such as those needed in many prior combination locks. Rather liberal manufacturing tolerances can be allowed.

The lock wheels 61, 63, 161, 163 are intended to be manufactured in quantity with the drive tabs or lugs 73 or 173 randomly located in many different positions (the different positions being, however, at angular increments of 3.6 degrees from each other, or multiples thereof) so that a very large number of different combinations is obtained depending upon which two lock wheels a person happens to pick up and use when assembling a particular combination lock at the factory. But beyond this, many changes of the combination are possible. Any one of the lock wheels can be reversed, or the two lock wheels can be interchanged with each other, in both embodiments. Also in the first embodiment, the drive screw 59 can be unscrewed from one hole and screwed into a different hole in the drive wheel 51, which will change the combination. And in both embodiments, the dial can be removed from the front end of the spindle and replaced in a different position, four possible positions being available since the front end of the spindle is square and the receiving hole in the dial is square. This combination lock can not be set at will to a particular numerical combination selected by the user, as is possible with some more expensive locks, but although this is not possible, it is nevertheless possible to make a great many changes in the combination by taking the steps above mentioned.

A common method of attempting forced entry is to drive the lock spindle inwardly. If this is done with the present lock, the drive wheel 51 or 151 will be carried inwardly with the spindle, leaving the lock wheels 61 and 63 or 161 and 163 in place on the bushing, and there will be no way for the intruder to turn them so the forced entry can not be accomplished in this way.

In most combination locks, the lock mechanism is contained in a case or housing which is mounted to the door on which it is to be used. The present lock mechanism, on the contrary, is assembled directly to the door, thereby reducing the cost and also making it more difficult to dislodge the latch in a forced entry attempt.

Another advantage of the present construction is that if a manufacturer desires to use this lock on a door or closure panel of different thickness than that for which the design was originally made, the only production change that is needed is to make the spindle and bushing longer or shorter, as the case may be. No extensive redesign or engineering work is needed.

What is claimed is:

1. A combination lock for mounting on a heat resistive panel such as a safe door, comprising an operating dial on one side of said panel, movable lock mechanism on an opposite side of said panel, a spindle extending through the thickness of said panel and operatively connecting said dial to said movable lock mechanism, and a bushing surrounding said spindle, characterized by the fact that both said spindle and said bushing are formed of non-metallic material having relatively low heat conductivity, so that in case of a fire on one side of said panel, said spindle and bushing will not provide an efficient path for transmission of heat to the other side of the panel.

2. The invention defined in claim 1, wherein said spindle and bushing are made of nylon.

3. A combination lock comprising a plurality of wheels each having a radial slot, a rectilinearly movable slide having a finger positioned to enter the slots in the wheels when all of the wheels are oriented to place their respective slots in alignment with said finger, a spring tending to move said slide in a direction to draw said finger into said slots, and a latch member engaged by said slide and moved to an unlatched position by movement of said slide during movement of said finger into said slots, the movement of the slide and the movement of the latch member being parallel to each other.

4. The invention defined in claim 3, wherein said latch member is movable relative to said slide between latched and unlatched positions while said slide is held against movement of its finger into said slots, and resilient means tending to keep said latch member in latched position relative to said slide.

5. The invention defined in claim 3, further comprising a spindle and a bushing surrounding said spindle, one of said wheels being fixed to said spindle to turn therewith, another of said wheels being rotatably mounted on said bushing, said slide having an opening through which said bushing extends so that the slide straddles the bushing.

6. The invention defined in claim 5, wherein said latch member has a central opening containing a major portion of said slide within said latch member.

7. The invention defined in claim 5, wherein a plurality of wheels are rotatably mounted on said bushing, further comprising a non-metallic spacer washer surrounding said bushing between two wheels thereon, a retaining ring on said bushing for limiting movement of said wheels and spacer washer in one axial direction along said bushing, and a spring washer tending to push said wheels axially toward said retaining ring and providing a light frictional drag opposing rotation of said wheels on said bushing.

8. The invention defined in claim 5, wherein said one wheel fixed to said spindle is formed integrally therewith.

9. The invention defined in claim 8, wherein said spindle and said one wheel are formed at least mainly of non-metallic plastic material having a relatively low coefficient of heat transmission.

10. A combination lock comprising a slide movable between a locked position and an unlocked position, a plurality of wheels mounted for rotation about a common axis of rotation and arranged to obstruct movement of said slide toward its unlocked position except when said wheels are in a predetermined rotational position, a latch movable relative to said slide between a latching position and an unlatching position, housing means including a plurality of housing parts assembled relative to each other to constitute a housing enclosing major portions of said slide and said latch but not enclosing said wheels, a first coiled spring within said housing engaging said slide and tending to move said slide toward its unlocked position, and at least one other coiled spring within said housing reacting between said slide and said latch and tending to move said latch to its latching position relative to said slide.

11. The invention defined in claim 10, wherein said first coiled spring pushes at one end against a portion of said slide and at its other end against a fixed part of said housing.

12. The invention defined in claim 10, wherein said housing parts are fastened in fixed position relative to each other in such manner that the housing and the slide and latch and the springs within the housing constitute a sub-assembly which can be handled as a unit during initial assembly of the combination lock and any subsequent servicing.

13. A combination lock comprising a rotary spindle, a drive wheel connected to said spindle to rotate therewith, a first lock wheel and a second lock wheel both rotatable concentrically with said spindle, means for rotating said first lock wheel from rotation of said drive wheel, means for rotating said second block wheel from rotation of said first lock wheel, a latch, a slide having a part movable toward and away from said spindle and operatively connected to said latch to move said latch to an unlatching position when said slide part moves toward said spindle, said lock wheels each having a radial slot and serving to prevent said slide part from moving toward said spindle except when the radial slot is aligned with said slide part, said drive wheel having a periphery shaped like a cam circular through the major portion of its circumference and having a low point and rising in both directions from said low point to its circular portion, so that when said slide part is located in the slots of the lock wheels and at the low point of the periphery of the drive wheel, rotation of the spindle and drive wheel in either direction will cam the slide part out of the slots and move it away from the spindle.

14. The invention defined in claim 13, wherein said spindle and drive wheel are formed integrally from plastic material.

15. The invention defined in claim 13, wherein said spindle is rotatable within a stationary bushing, said lock wheels are mounted to rotate on said bushing, and said spindle and said bushing are both made of plastic material.

16. A combination lock comprising a plurality of wheels each having a radial slot and a movable member having a finger positioned to enter the slots in the wheels when all of the wheels are oriented to place their respective slots in alignment with said finger, and resilient means tending to move said finger into said slots, one of said wheels being of non-metallic material and being of such size that when the wheels are rotated, said finger will ride mainly on the periphery of said one wheel out of contact with peripheries of other wheels during at least a substantial part of a revolution of said one wheel, said one wheel having a periphery which is circular and concentric with the center of rotation of the wheel throughout the major part of its circumference, the slot in said one wheel being formed as an inwardly extending notch at one point, the wheel having peripheral portions of cam-like curved shape extending from the bottom of said notch to a circular part of the periphery, in each of two opposite circumferential directions from the bottom of said notch, so that when said finger is positioned at the bottom of said notch, it will be cammed out of the notch by rotation of the wheel in either direction.

17. A combination lock comprising a plurality of wheels each having a radial slot, a latch member movable along a straight line between a projected latching position and a retracted unlatching position, spring means tending to move said latch member toward its latching position, a slide also movable along a straight line parallel to the direction of movement of said latching member between a projected position and a retracted position, spring means tending to move said slide toward its retracted position, a finger on said slide positioned to engage the peripheries of said wheels to prevent movement of said slide toward its retracted position except when the radial slots of all of said wheels are aligned with said finger, whereupon the spring means of said slide may move the slide to its retracted position, a portion of said slide engaging said latch member during such movement of the slide to retracted position and serving to move the latch member to its retracted position.

18. The invention defined in claim 17, wherein the latch member and the slide are so shaped that the latch member may be moved from its projected position to its retracted position by external force without causing any movement of the slide.

* * * * *